United States Patent [19]

Beiswenger

[11] Patent Number: 4,635,170

[45] Date of Patent: Jan. 6, 1987

[54] REFLECTOR FOR ELECTRIC LIGHT

[75] Inventor: John L. Beiswenger, Salem, Wis.

[73] Assignee: Rayovac Corporation, Madison, Wis.

[21] Appl. No.: 810,216

[22] Filed: Dec. 18, 1985

[51] Int. Cl.[4] ..... F21L 15/06

[52] U.S. Cl. ..... 362/157; 362/200; 362/304; 362/308

[58] Field of Search ..... 362/157, 200, 341, 346, 362/328, 329, 326, 307, 308, 304, 305

[56] References Cited

U.S. PATENT DOCUMENTS

| | | | |
|---|---|---|---|
| 2,072,849 | 3/1937 | Dietrich | 362/329 |
| 2,338,078 | 12/1943 | Wood | 362/187 |
| 3,395,272 | 7/1968 | Nicholl | 362/305 |
| 4,423,473 | 12/1983 | Kirkley | 362/190 |
| 4,432,041 | 2/1984 | Pfisterer et al. | 362/86 |
| 4,504,889 | 3/1985 | Goldfarb | 362/200 |
| 4,506,314 | 3/1985 | Moore | 362/328 |
| 4,530,040 | 7/1985 | Petterson | 362/328 |

*Primary Examiner*—E. Rollins Cross

*Attorney, Agent, or Firm*—Garrettson Ellis

[57] ABSTRACT

A reflector for an electric light has a first reflector member with a socket for the light bulb and a second reflector member positioned generally forward of the socket. In one aspect of the invention a first angular segment of the first reflector defines curved reflector means for reflecting light from the light in the socket into a collimated beam. The remaining angular segment of the first reflector defines a transversely directed, curved reflector for focusing light from the light bulb back to the filament in the light bulb to increase the filament temperature. In another aspect of the invention, the first, angular segment of the second reflector member defines a transparent partition, with the partition carrying a plurality of transparent ridges of triangular cross section. The ridges are circumferentially disposed at different radii about an extension of the central axis of the socket. Thus light from the light bulb in the socket is diffracted by the ridges into the collimated beam.

21 Claims, 3 Drawing Figures

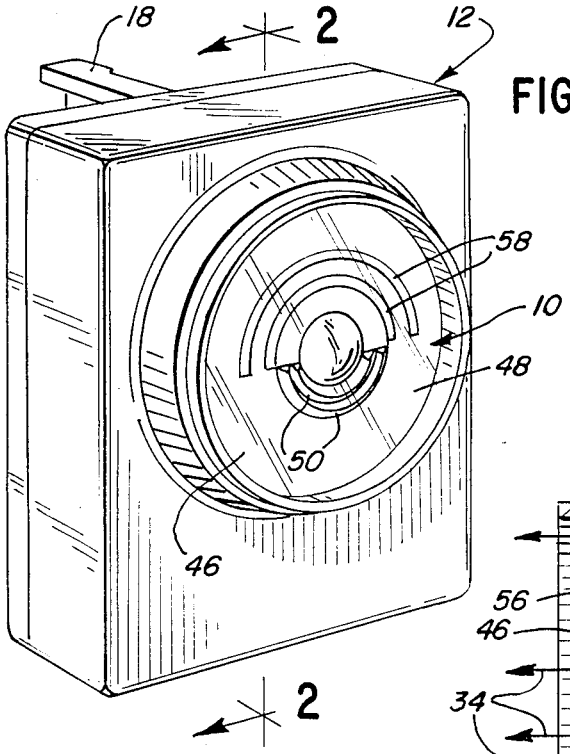
FIG. 1
FIG. 2
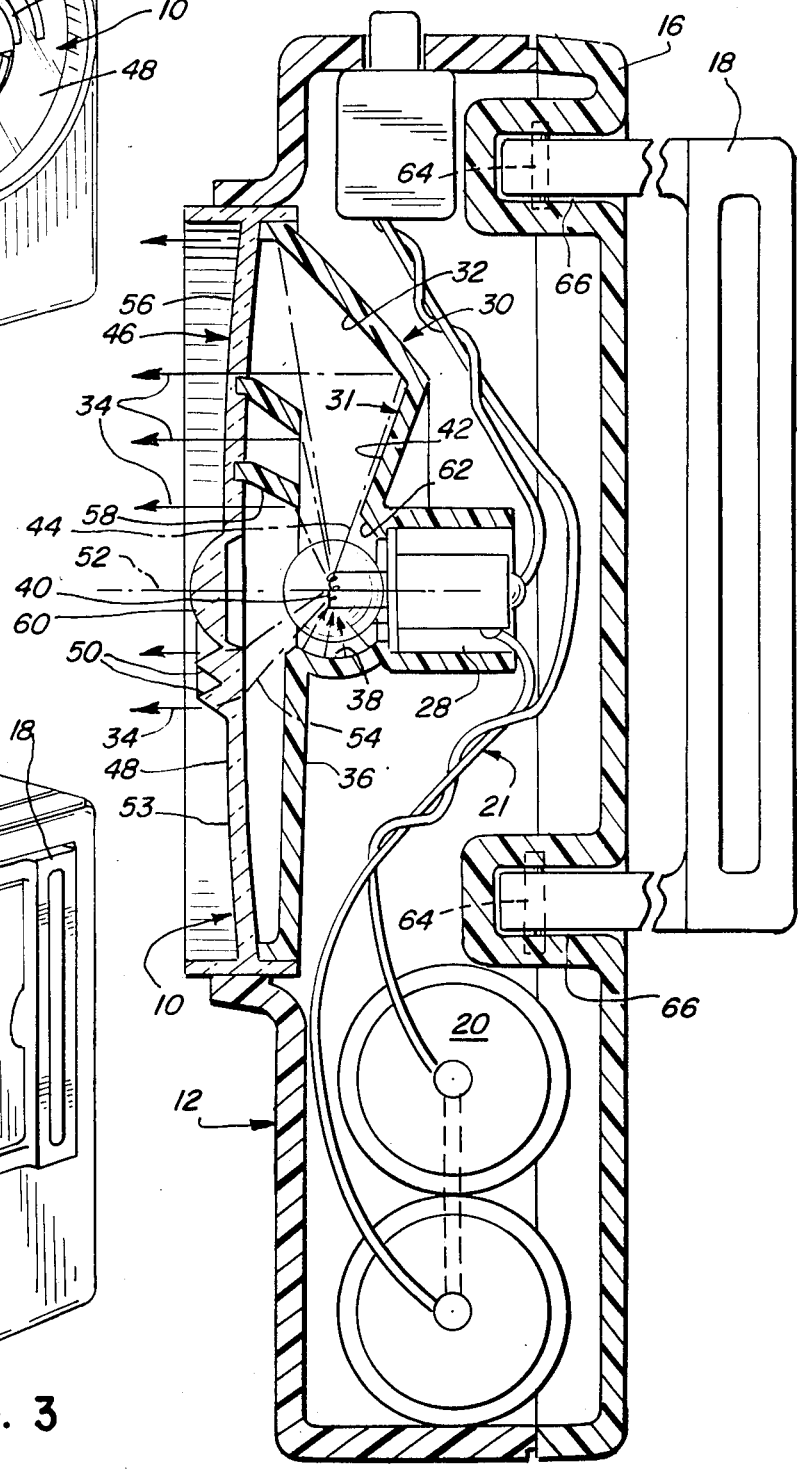
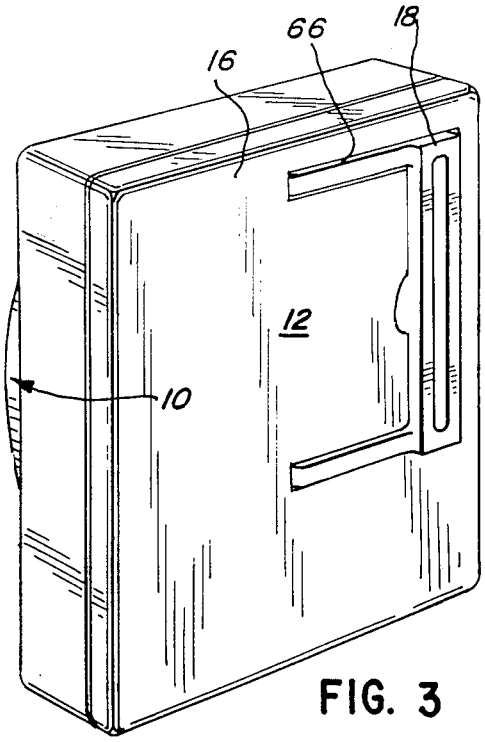
FIG. 3

REFLECTOR FOR ELECTRIC LIGHT

BACKGROUND OF THE INVENTION

There is a continuing need for a new design of electric light which provides a light beam having better collimation, while the electric light itself can be compact, and operating at improved efficiency. With improved efficiency, a battery operated light can operate for greater lengths of time. With the beam of improved collimation, objects at greater distances can be illuminated with the same output of light.

In Nicoll, U.S. Pat. No. 3,395,272, there is disclosed a generally conventional, elongated flashlight having an unusual reflector member, in which some of the reflector is forward of the light bulb, above and beyond a well known parabolic reflector to the rear of the light bulb. Such a structure is alleged to provide better concentration of light in the form of a light beam, while avoiding the central area of low intensity light which is found in many lights with conventional reflectors.

Typically, when a compact flashlight or the like is provided with a casing that is wider than it is long, it is generally required that the reflector be designed in a less than optimum configuration, so that light beams from such devices have a considerable amount of spread, and thus operate poorly for illuminating distant objects.

In accordance with this invention, an electric light is provided which may have the advantage of a very short depth, while at the same time the parallel beam characteristic of collimation of the light emitted can be excellent, for improved illumination of distant objects. Furthermore, the efficiency of the light may be improved over other designs, in that more of the radiation emitted by the filament of the light bulb ultimately finds its way into the collimated light beam, rather than being wasted as heat.

Accordingly, the electric light of this invention may be used as a flashlight, an automobile headlight, a spotlight, an airplane landing light, or any of many other uses, while being in a configuration that is more convenient in many circumstances for carrying in the hand, installation in a bracket on the front of a vehicle, or the like.

DESCRIPTION OF THE INVENTION

A reflector for an electric light is provided having a first reflector member surrounding socket means for carrying a light bulb. A second reflector member is positioned generally forward of the socket means. In accordance with this invention, a first angular segment of the first reflector defines curved reflector means reflecting light from a light bulb in the socket into a collimated beam. The remaining angular segment of first reflector defines a transversely directed, curved reflector for focusing light from the light bulb back to the filament in the light bulb to increase the filament temperature. Thus, this transversely focused and reflected light, which is often lost as heat in prior art reflector designs, serves to elevate the temperature of the filament, which of course increases its light output. Because of this, it becomes possible to reduce the voltage and amperage of the electric current flowing through the filament, so that the same amount of filament illumination is achieved for less electric current, as compared with analogous prior art structures.

The first angular segment of the first reflector, and the remaining angular segment, may each occupy essentially about 140° to 210° around the central axis. In the specific embodiment shown both of the angular segments are essentially 180°.

In another aspect of this invention, a first, angular segment of the second reflector, positioned generally forward of the socket means surrounded by the first reflector, defines a transparent partition. The partition carries a plurality of transparent ridges of triangular cross section, the ridges being circumferentially disposed at different radii about an extension of the central axis of the socket, to cause light from a light bulb in the socket to be diffracted by said ridges into a collimated beam.

When both of the above inventive features are incorporated in the same reflector, it is typically intended that both of them reflect and diffract light into the same collimated beam, for a highly parallel beam capable of illuminating distant objects.

A second, angular segment of the second reflector member also defines a transparent partition. The second segment carries curved, circumferentially disposed, elongated reflector members which are positioned to reflect light from the light bulb to join the collimated beam.

As in the first reflector member, the angular segments of the second reflector member typically each occupy essentially 140° to 210° about the central axis. In the specific embodiment shown, they each occupy about 180°, forming a full circle for efficient collection and reflection of light. In fact, the complete reflector of this invention has the capability of directing into the collimated beam of light essentially all of the light illuminated by the light bulb in a spherical section defined by an arc of at least 220° and preferably about 240° or more, for highly efficient light collection and operation. It should be understood that a spherical section of 180° is a one-half sphere. Thus it can be seen that a spherical section of light collectible by the reflector of this invention in its preferred embodiment is substantially more than a half sphere of the light emitted by the light bulb.

Furthermore, the second reflector member may define a lens positioned about an extension of the central axis of the socket means, to focus centrally directed light into the same collimated beam as the other light reflecting and diffracting means of this invention.

Preferably, a casing is used with the reflector of this invention in which the casing and the reflector together have a width that is at least twice as great as the depth, the depth being measured generally parallel to the beam of light emitted thereby.

The first reflector member may define, in the first angular segment, a radially inward surface which is substantially flat, being positioned to the rear of the center of the light bulb in the socket, and substantially parallel to the nearest paths of light emission from the light bulb. A generally radially outer surface, compared with the inner surface, has a generally parabolic reflective surface to reflect light from the bulb into the substantially parallel beam. This structure provides ease of molding, and facilitates collection of more light for focusing into the collimated beam, in that the radially inward surface may be tapered rearwardly, exposing a large portion of the sphere of light emitted by the light bulb to reflection rather than being wasted as heat.

DESCRIPTION OF DRAWINGS

In the drawings, FIG. 1 is a front perspective view of a flashlight which carries the reflector of this invention.

FIG. 2 is an enlarged, sectional view taken along line 2—2 of FIG. 1.

FIG. 3 is a rear perspective view of flashlight of FIG. 1.

DESCRIPTION OF SPECIFIC EMBODIMENT

Referring to the drawings, reflector 10 of this invention is carried in a housing 12 which may be of the general design of the patent application of John L. Beiswenger, entitled "Compact Electric Light" and filed concurrently herewith.

Housing 12 may comprise front and rear sections 14, 16 and may preferably be proportioned so that the width, i.e., each transverse dimension, may be at least twice as great as the combined length or depth of housing 12 and reflector 10, when folding handle 18 is in its folded configuration. The reason such a structure is possible, while housing 12 remains compact and often portable, is the design of reflector 10, which can provide an efficient, collimated light beam without being a deep reflector of substantial axial extent.

Battery 20 and conventional circuitry 21 may be provided so that light bulb 22 can be illuminated.

Turning to the structure of reflector 10, first reflector member 31 includes a first, angular segment 30, typically comprising about 180° of extent around light bulb 22, defines curved (parabolic) reflector means 32 for reflecting light from light bulb 22 into the collimated beam, which is illustrated by arrows 34.

The remaining angular segment 36 of first reflector 31 defines a transversely directed, curved reflector 38, which has the function of focusing light from light bulb 22 right back to filament 40, to increase the filament temperature. Because the filament temperature is increased by this focus of returning light, the radiation that it emits is also increased in intensity and energy. If desired, one may thus reduce the voltage and current passing through the filament, to cause it to drop back to a standard temperature. This results in an increase of efficiency in that less electric power will be used in such a system when compared with corresponding systems of the prior art. Alternatively, if the filament is allowed to operate at the higher temperature, it provides more light for the same amount of electric power.

The first reflector member also defines, in the first angular segment 30, a radially inward surface 42 which is substantially flat, and positioned to the rear of the center of light bulb 22 in socket 28. Flat surface 42 is seen to be substantially parallel to the nearest paths of light emission 44 from light bulb 22, and serves as a structural member to support and position radially outer surface 32. The rearward taper of surface 42 permits a larger amount of the light emitted by bulb 22 to reach reflective surface 32.

Second reflector member 46 is positioned generally forward of the socket 28, and typically comprises a transparent partition. It also defines a first, angular segment 48 which carries a plurality (specifically two) of transparent ridges 50 of triangular cross section. Ridges 50 are seen to be circumferentially disposed at differing radii about an extension 52 of the central axis of socket 28. As shown in FIG. 2, beams of light 54 may be diffracted by ridges 50 into the parallel, collimated beams 34.

First angular segment 48 may also have some dead space 53 which is not exposed to light from bulb 22. There, the partition defining second reflector member 46 may be opaque if desired.

Second angular segment 56 of second reflector member 46 also uses a transparent partition, carrying curved, circumferentially disposed, elongated parabolic reflector members 58, which are positioned to reflect light from bulb 22 to join the collimated beam 34.

The transparent partition of second reflector member 46 also defines a central lens 60, which is positioned about extension 52 of the central axis. Lens 60 serves to focus centrally directed light into collimated beam 34 as well.

Accordingly, it can be seen, counting lateral reflecting surface 38, that well over a half sphere of the light emitted by bulb 22 is captured by the reflector of this invention for focusing into collimated beam 34. The light reflected by lateral reflecting surface 38 returns to the filament, but is not lost since its heat energy results in heating of the filament and consequent reradiation.

Small surface 62 may also be made as a reflective, curved surface for focusing and returning light to filament 40.

By comparing FIGS. 1 through 3 it can be seen that handle 18 can swing outwardly (FIGS. 1 and 2), but then may be pivoted inwardly about pivots 64 into a recessed groove 66 which is proportioned to receive handle 18 in substantially flush relation with the rear portion 16 of casing 12 (FIG. 3).

Accordingly, an electric light with a novel reflector is provided, in which the reflector may acquire a larger percentage of light emitted by the light bulb for greater efficiency of operation, while being of short depth, for use in a compact light system.

The above is offered for illustrative purposes only, and is not intended to limit the scope of the invention of this application, which is as defined in the claims below.

That which is claimed is:

1. In a reflector for an electric light having a first reflector member defining socket means for carrying a light bulb, and a second reflector member positioned generally forward of said socket means, the improvement comprising in combination:

a first angular segment of said first reflector defines curved reflector means for reflecting light from a light bulb in the socket into a collimated beam, the remaining angular segment of said first reflector defining a transversely directed, curved reflector for focusing light from said light bulb back to the filament in said light bulb to increase the filament temperature.

2. The reflector of claim 1 in which the first angular segment of said first reflector defining curved reflector means is essentially 180°, and said remaining angular segment is essentially 180°.

3. The reflector of claim 1 in which at least a first, angular segment of said second reflector member defines a transparent partition, said partition carrying a plurality of transparent ridges of triangular cross-section, said ridges being circumferentially disposed at different radii about an extension of the central axis of said socket means, whereby light from a light bulb in said socket means is diffracted by said ridges into said collimated beam.

4. The reflector of claim 3 in which a second angular segment of said second reflector member also defines a transparent partition, said second segment carrying curved, circumferentially disposed, elongated reflector members positioned to reflect light from said light bulb to join said collimated beam.

5. The reflector of claim 1 in which said second reflector member defines a transparent partition, and at least an angular segment of said partition carrying curved, circumferentially disposed, elongated reflector members positioned to reflect light from said light bulb to join said collimated beam.

6. The reflector of claim 1 in which said second reflector member defines a lens positioned about an extension of the central axis of said socket means, to focus centrally directed light into said collimated beam.

7. The reflector of claim 1 which is carried in a casing, said casing and reflector together having a width that is at least twice as great as its depth, said length being measured generally parallel to the beam of light emitted thereby.

8. The reflector of claim 1 in which said first reflector member defines, in said first angular segment, a radially inward surface which is substantially flat, positioned to the rear of the center of a light bulb in said socket, and substantially parallel to the nearest paths of light emission from said light bulb, and a radially outer surface from said inner surface which has a generally parabolic, reflective surface to reflect light from said bulb into said substantially parallel beam.

9. An electric light in accordance with claim 8 in which said reflector is carried by a casing, a bulb positioned within said socket, and means for electrically illuminating said bulb, said reflector being capable of directing into said collimated beam essentially all of the light emitted by said light bulb in a spherical section defined by an arc of at least 220°.

10. The electric light of claim 9 in which a folding handle is carried on the side of said casing facing away from said collimated beam.

11. In an electric light which comprises a reflector, a casing, a light bulb socket carrying a light bulb, and means for electrically energizing said light bulb, said electric light having a first reflector member surrounding socket means carrying said light bulb, and a second reflector member positioned generally forward of said socket means, the improvement comprising, in combination:

a first angular segment of said first reflector defining curved reflector means for reflecting light from a light bulb in the socket into a collimated beam, the remaining angular segment of said first reflector defining a transversely directed, curved reflector for focusing light from said light bulb back into the filament in said light bulb to increase the filament temperature; at least a first, angular segment of said second reflector defining a transparent partition, said partition carrying a plurality of transparent ridges of triangular cross-section, said ridges being circumferentially disposed at different radii about an extension of the central axis of said socket means, whereby light from said light bulb is diffracted by said ridges into said collimated beam.

12. The reflector of claim 11 in which a second angular segment of said second reflector member also defines a transparent partition, said second segment carrying curved, circumferentially disposed, elongated reflector members positioned to reflect light from said light bulb to join said collimated beam.

13. The reflector of claim 12 in which said second reflector means defines a lens positioned about said central axis to focus centrally directed light into said collimated beam.

14. The electric light of claim 13 in which said casing and reflector together have a width that is at least twice at great as its depth, said depth being measured generally parallel to the beam of light emitted thereby.

15. The electric light of claim 14 in which said reflector is capable of directing into said collimated beam essentially all of the light emitted by said light bulb in a spherical section defined by an arc of at least 220°.

16. The electric light of claim 15 in which said second reflector member is an integrally molded, transparent plastic sheet, said curved, circumferentially disposed, elongated reflector members projecting inwardly from said plastic sheet and carrying a reflective surface coating, said transparent ridges of triangular cross-section projecting outwardly.

17. The electric light of claim 16 in which the first and second angular segments of said second reflector member each occupy essentially 140° to 210° about said central axis.

18. In a reflector for an electric light having a first reflector member defining socket means for carrying a light bulb, and a second reflector member positioned generally forward of said socket means, the improvement comprising, in combination;

at least a first angular segment of said second reflector member defining a transparent partition, said partition carrying a plurality of transparent ridges of triangular cross-section, said ridges being circumferentially disposed at different radii about an extension of the central axis of said socket means, whereby light from a light bulb in said socket means is diffracted by said ridges into a collimated beam.

19. The reflector of claim 18 in which a second angular segment of said second reflector member also defines a transparent partition, said second segment carrying curved, circumferentially disposed, elongated reflector members positioned to reflect light from said light bulb to join said collimated beam.

20. The reflector of claim 19 in which said second reflector means defines a lens positioned about said central axis to focus centrally directed light into said collimated beam.

21. An electric light which comprises a casing, the reflector of claim 20, and means for electrically illuminating a light bulb in said socket, said reflector and casing together defining a width that is at least twice as great as its depth.

* * * * *